United States Patent [19]

Polino et al.

[11] Patent Number: 4,807,457

[45] Date of Patent: Feb. 28, 1989

[54] LINE TO COOL WOUND BUNDLES OF ROLLED WIRE AND ROD

[75] Inventors: Alfredo Polino, Ronchi Dei Legionari; Geremia Nonini, Buttrio; Ferruccio Tomat, Udine, all of Italy

[73] Assignee: Danieli & C. Officine Mecchaniche SpA, Buttrio, Italy

[21] Appl. No.: 125,935

[22] Filed: Nov. 27, 1987

[30] Foreign Application Priority Data

Dec. 2, 1986 [IT] Italy ..... 60520 B/86

[51] Int. Cl.[4] ..... B21B 45/02; B21B 43/00; B21C 47/02

[52] U.S. Cl. ..... 72/128; 72/148; 72/201

[58] Field of Search ..... 72/200, 201, 202, 342, 72/128, 146, 148; 140/2; 266/106, 259; 242/79, 80

[56] References Cited

U.S. PATENT DOCUMENTS 4,054,276 10/1977 Wilson ..... 266/106

FOREIGN PATENT DOCUMENTS 0143488 6/1985 European Pat. Off. .
0180254 5/1986 European Pat. Off. .
2344636 10/1977 France .
1160488 8/1969 United Kingdom .
2158745 11/1985 United Kingdom .

*Primary Examiner*—E. Michael Combs
*Attorney, Agent, or Firm*—Wegner & Bretschneider

[57] ABSTRACT

Line to cool wound bundles of rolled wire and rod, the diameter of the rolled stock processed on the line ranging from a few millimeters up to about 45 mm., the line comprising a head (12) to form coils of wire, a roller conveyor (13), a cooling tunnel (15), a reel (14) to collect coils and to form wound bundles of wire and a conveyor to discharge wound bundles of wire and rod, two Garrett-type reels (28) being included at the sides of the coil-forming head (12) coiling the wire.

7 Claims, 4 Drawing Sheets

LINE TO COOL WOUND BUNDLES OF ROLLED WIRE AND ROD

This invention concerns a line to cool wound bundles of rolled wire and rod, the line being suitable to handle the whole range of wire and rod wound in bundles.

The range of dimensions of the rolled stock which can be processed on the cooling line according to the invention extends from a diameter of a few millimeters up to diameters of about 45 mm. and more and covers speeds of feed ranging from more than 100 mts. per second to a few mts. per second.

Rolling plants exist at present which comprise at one end one or more reels to collect rolled stock in the form of wound bundles.

Such reels are normally served by their own cooling line and are individually equipped to suit the diameter of the rolled stock.

Thus, there are reels to form wound bundles of wire having diameters of about 5 mm. up to about 14–16 mm., and there are reels of form wound bundles of rod having diameters of about 14–16 mm. up to about 40–45 mm. and more.

These ranges of dimensions entail very wide ranges of speed of feed, which may extend from a few mts. per second up to speeds higher than 100 mts. per second.

The reels to form wound bundles of wire are served by coil-forming heads able to form the coils at a high speed and to deliver them to roller conveyors, which then deliver them to the reels.

These roller conveyors can be flat or sloped upwards and be served by a tunnel providing controlled cooling.

Owing to the small diameter of the wire the coils settle onto, and adapt themselves readily to, the reel which forms the wound bundle.

When the bundle has been formed, it is withdrawn according to any of the systems of the known art, such as overhead hooks, roller conveyors, etc.

The coils of wire on the roller conveyor can travel flattened or substantially upright, but the cycle remains essentially the same.

The case of rolled stock having diameters greater than 16–18 mm. and called rod is, however, different.

Appropriate reels have been designed for the rod and either accept coils already formed (Edenborn reels) or themselves form the coils (Garrett reels).

Reels of the Edenborn type form the coils vertically while the rolled stock is still hot and the coils retain a certain plasticity.

The plurality of coils thus formed is collected by a reel until the bundle has been formed, and the latter is then withdrawn and removed on a roller conveyor or another means.

Reels of the Edenborn type are suitable to cover the range of diameters up to 12–14 mm.

In the case of reels according to the Garrett system, the reel itself rotates while receiving the rolled stock, winds it and forms the wound bundle.

This type of reel is normally employed with the higher range of diameters, called rod, and with the lower range of speeds of feed. In this case too the wound bundle is discharged in a known manner.

When the known systems generally have to handle the bundling of products divided into two or more sizes of diameter, they provide appropriate specific lines to form bundles with individual systems to control the cooling.

The known systems, therefore, entail problems of logistics (space, lay-out, integration of machines and plant, utilities, etc.), tying-up of capital, maintenance, storage of spares, installation, procurement and transport within the factory.

Document EP-A-0143488 discloses a plant to form and for the heat treatment of rolled products in coils and compact wound bundles.

The plant comprises, respectively, means for forming wound bundles and means for forming coils.

A cooling conveyor is provided, whose initial section can cooperate either with the wound bundles forming means or with the coil forming means.

No mention is made in said document about the thickness of the rolled product, and whether the product is rolled according to the Edenborn or the Garrett methods.

Document GB-A-1,160,488 discloses a coiling apparatus for double-refined steel comprising a combined Garrett reel supplied either directly, in the case of thicker products, or by means of a turn-layer and a funnel in the case where a thinner product has to be wound.

No mention is made in said document about the subsequent cooling process and how this is performed.

A specific reel acting according to the Edenborn method is not foreseen.

The present applicant has the purpose of overcoming such known problems by means of the invention, and also of embodying integrated lines to form wound bundles and to cool them, the lines having a low cost, taking up little space and requiring a minimum of maintenance.

According to the invention a line to prepare coils and form wound bundles is provided for wire. This line is complete with coil-forming head, cooling roller conveyor, cooling tunnel, reel to collect coils for the formation of wound bundles and a conveyor to discharge the wound bundles.

The cooling roller conveyor possesses the technical features required for the function it has to perform.

In one embodiment the cooling tunnel which cooperates with the cooling roller conveyor is of a type having a height suitable for the passage of a wound bundle having its axis positioned at a right angle to the plane of the development of the roller conveyor.

In a variant the tunnel is of a type able to take up four working positions; one position for the passage of coils loaded flat on the roller conveyor; another position for the passage of substantially vertical coils; another position for the passage of wound bundles; and another opened position for rapid cooling with air, which may possibly be blown.

According to the invention two coiler reels of the Garrett type, which are suitable to form wound bundles of rod, are provided on cooperation with the head forming coils of wire and substantially at the sides of that head.

According to the invention the coiler reels for rod may be located below the plane of the cooling roller conveyor or may cooperate with that plane.

The coiler reels for rod are equipped with means to remove the wound bundles towards the axis of movement of the roller conveyor so as to enable the wound bundles to be taken on that conveyor through the cooling tunnel.

At the end of the tunnel, in which the wound bundle has been cooled in a controlled manner, the bundle is discharged and sent to the successive usage means.

Discharge of the bundle may be performed sideways at the level of its arrival or by vertical displacement to a lower level.

The invention is therefore embodied with a line to cool wound bundles of rolled wire and rod, the diameter of the rolled stock processed on the line ranging from a few millimeters up to about 45 mm., the line comprising a head to form coils of wire, a roller conveyor, a cooling tunnel, a reel to collect coils and to form wound bundles of wire and a conveyor to discharge wound bundles of wire and rod, the line being characterized in that two Garrett-type reels are included at the sides of the coil-forming head coiling the wire.

The attached figures, which are given as a non-restrictive example, show the following:

Figure 6A:
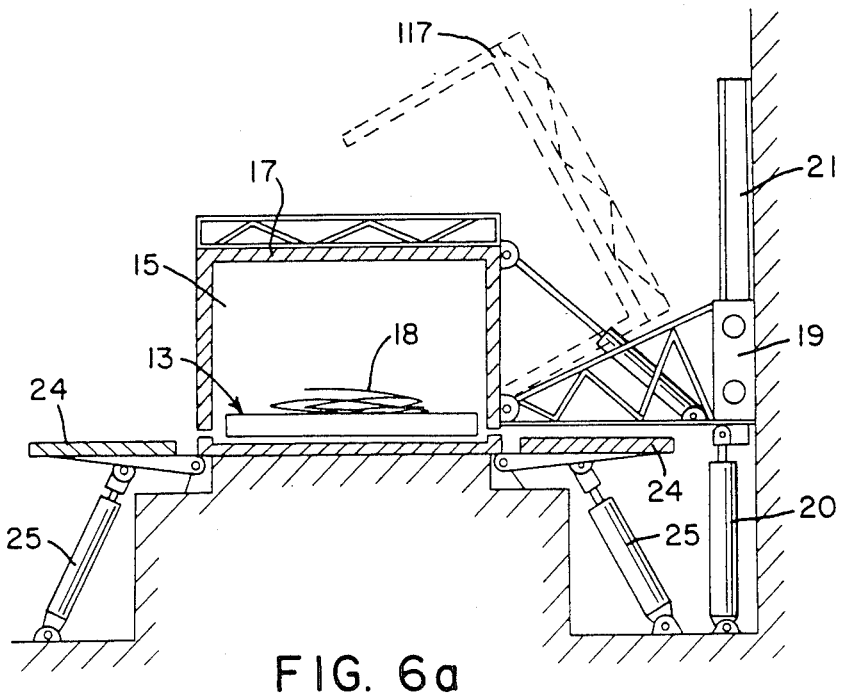
Figure 6B:
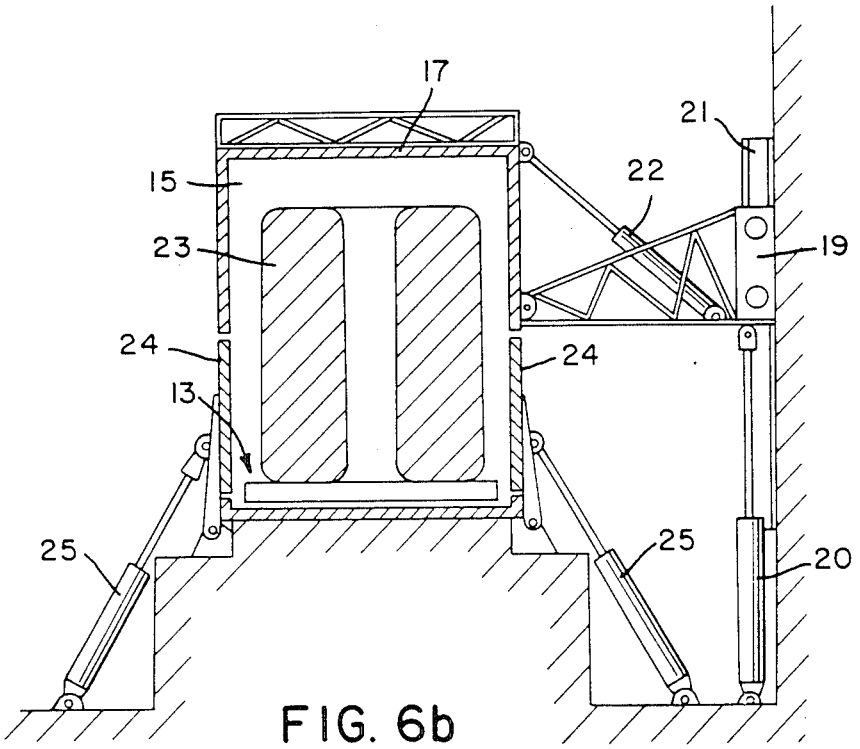

FIGS. 6*a* and 6*b* show cooling tunnel.

The figures show a normal line to form wound bundles of wire. This line comprises a delivery system 111 for the wire, a coil-forming head 12 to produce coils 18, a roller conveyor 13 which in this case is of an ascending type, and a reel 14 to form wound bundles of wire 123, the reel being positioned at the end of the roller conveyor 13.

The reel 14 can be of any type, as also can the systems for discharging the wound bundles 123 of wire being formed on the reel 14 with which these systems cooperate.

Figure 2:
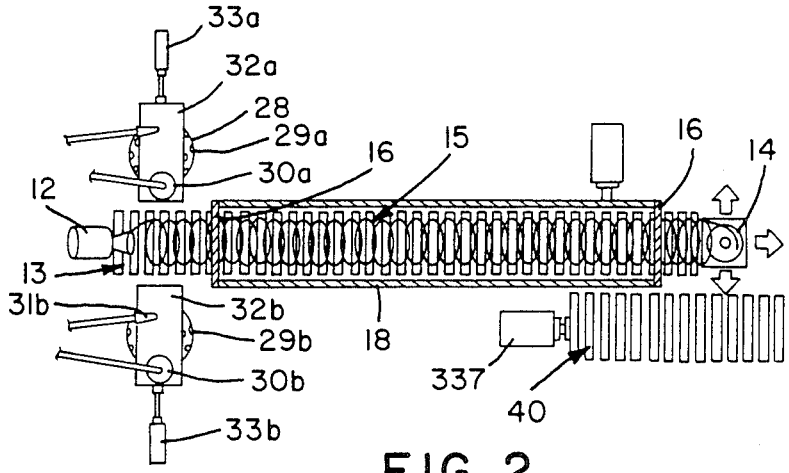
FIG. 2 shows a plan view of the embodiment of FIG. 1 with the tunnel cutaway and the coils passing through flattened.
Figure 3:
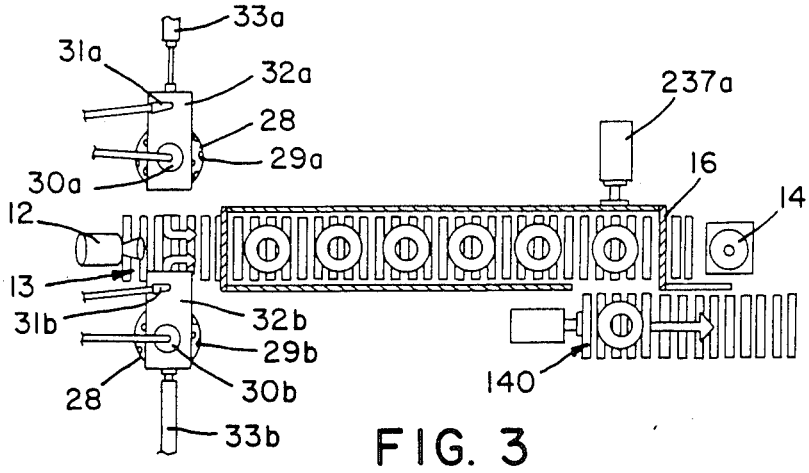
FIG. 3 shows a plan view of the embodiment of FIG. 1 with the tunnel cutawy and with the coils wound according to the Edenborn system.
Figure 4:
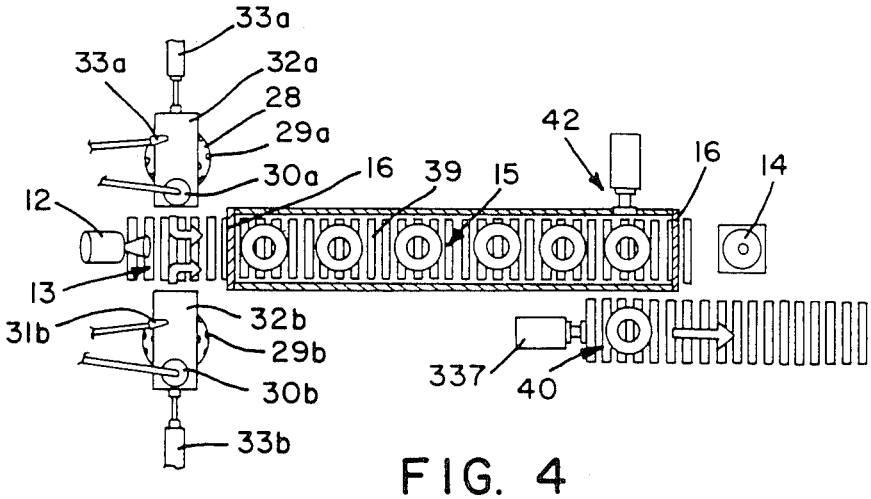
FIG. 4 shows a plan view of the embodiment of FIG. 1 with the tunnel cutaway and with the coils wound according to the Garrett system.

The coils 18 of wire can be produced and deposited in an inclined position, as shown in the examples of FIG. 2 and FIG. 6*a*, or deposited substantially upright, on the roller conveyor 13.

A cooling tunnel 15 is provided on the roller conveyor 13 and comprises movable doors 16 at its entry and exit to obtain a better control of its temperature and conditions.

One or more devices 26 to provide forced draught may cooperate with the tunnel 15.

In the example shown the cooling tunnel 15 is of a type with three positions (FIG. 6). It has a hood 17 lowered in a first position (FIG. 6*a*), whereas the hood 17 is raised in a second position and leaves open to the air the coils 18 produced in the coil-forming head 12.

In the example of FIG. 6*a* the hood 17 is supported pivotally on the frame with a carriage 19, which can run on guides 21 and is moved vertically by a lifting device such as a jack 20, for instance.

The closed position (continuous lines of FIG. 6*a*) of the hood 17 or its open position (lines of dashes in FIG. 6*a*) is obtained with an actuator 22, which may be a jack, for example.

In its third embodiment (FIG. 6*b*) the tunnel 15 rises to enable the wound bundles 23 to pass through. Such ascent of the tunnel 15 is obtained in this case by the hood 17 being lifted by a lifting device 20, such as a jack, and by the insertion of side panels 24, which here are positioned by positioner devices 25, which may be jacks, for instance.

Other known forms of tunnel may be included.

The doors 16 are positioned at the entry and exit of the tunnel 15 by a positioner device 125, which may be a jack providing vertical actuation.

As we said earlier, devices 26 of a known type, such as fans, to produce a forced cooling draught may cooperate with the roller conveyor 13. Such forced cooling draught devices 26 may be positioned below the roller conveyor 13 (FIG. 1) or in cooperation with the hood 17 or in cooperation with the side panels 24 of the hood.

According to the invention two reels 28 are located at the sides of the zone where the coil-forming head 12 deposits coils 27 of wire. These two reels 28 are of the Garrett type and comprise a retractable drum for discharge of formed wound bundles 23.

The Garrett-type reels 28 can be fed by a coil-forming head 30 of the Edenborn type in the case of intermediate diameter sizes, in which case the reels 28 remain stationary, or by an intake 31 in the case of larger diameter sizes, in which case the reels 28 rotate.

Figure 1:
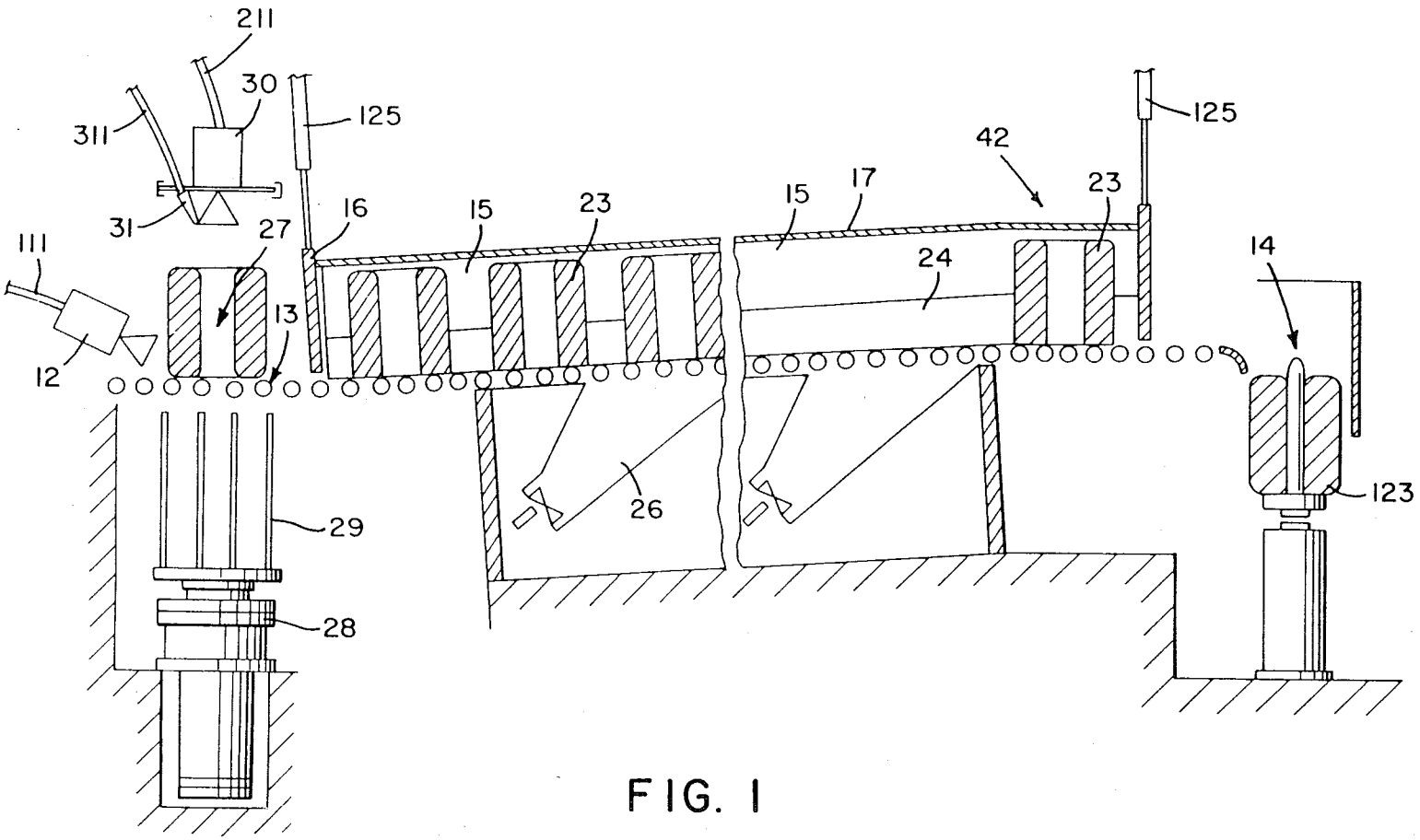
FIG. 1 shows a lengthwise section of an embodiment of the invention.

The Edenborn coil-forming head 30 and the intake 31 are fed by delivery lines, which are numbered 211 and 311 in FIG. 1.

The Edenborn coil-forming head 30 and the intake 31 may be borne on a carriage 32 able to position either of them 30 or 31 correctly in relation to the Garrett reel 28 and, in particular, to the drum 29 of the respective reel 28.

In a variant the Edenborn head 30 remains always correctly positioned, whereas when the intake 31 is not in use, such intake is displaced sideways so as not to contact the coils formed by the Edenborn coil-forming head 30.

As indicated earlier, a Garrett-type reel 28 and Edenborn head 30, along with the various related machinery (intake 31, positioner carriage 32, etc.), are located on either side of the head 12. For convenience, in FIGS. 2–5, these items on one side of the head 12 are labeled with an "a", and on the other side with a "b".

Each Garrett reel 28 is complete, as indicated above.

The deliver lines 111, 211 and 311 may receive materials from a plurality of rolling lines or from one single rolling line.

Figure 5:
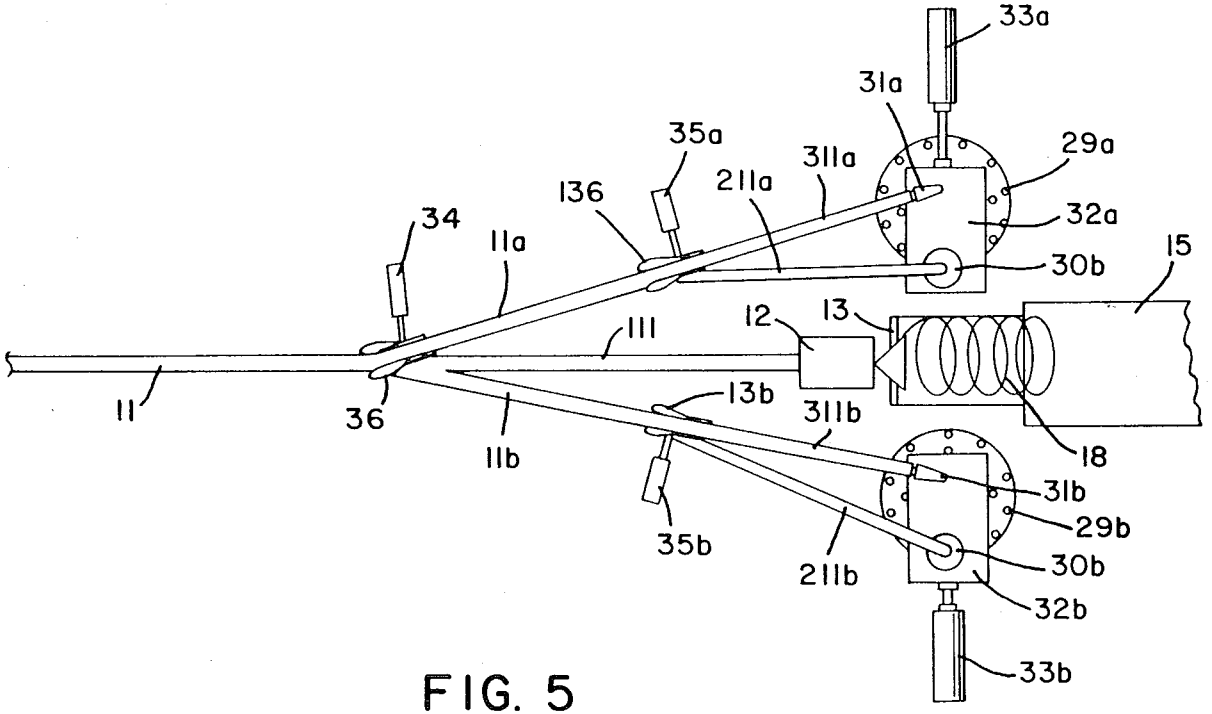
FIG. 5 shows a system for distributing the rolled stock arriving at the reels.

If material, whether wire or rod, arrives along one single feed line 11, the invention provides the variant shown in FIG. 5, where the feed line 11 can feed the line 111 or the lines 11*a* or 11*b* alternately.

If wire is being processed, the delivery line 11 will feed the line 111, whereas if rod is being processed, the delivery line 11 will feed the lines 11*a* and 11*b* alternately to enable the wound bundles 23 formed on the reels 28 to be removed.

Switches 36 are provided to feed one or another of the feed lines and in this example are actuated by a jack 34. These switches direct the material coming along the delivery line 11 to the feed line 11*a*, 11*b* or 111 selected.

Where each Garrett-type reel 28 is equipped with a positioner carriage 32 actuated by a jack 33, each of the two feed lines 11*a*–11*b* may be provided with a switch 136 actuated in this case by a jack 35. The position of these switches 136 will be conditioned by the type of feed cooperating with the reel 28 in question.

Thus, if the reel 28 is stationary and cooperating with the Edenborn-type coil-forming head 30, the switches 136 will connect the feed lines 11*a* and 11*b* to the lines 211*a* and 211*b* respectively.

Instead, if the reel 28 is actually rotating and therefore cooperating with the intake 31, the switches 136 will connect the feed lines 11*a* and 11*b* to the lines 311*a* and 311*b* respectively.

When a wound bundle 23 has been formed on a specific reel 28, the drum 29 is retracted and the bundle is discharged by an ejector, which sends the bundle onto the roller conveyor 13.

The bundle 23 is then taken on the roller conveyor 13 to a discharge station 42 positioned advantageously, but not necessarily, within the cooling tunnel 15.

The wound bundle 23 is then displaced by the ejector 237 and delivered, for instance, to a discharge conveyor 40 of a desired type, with which a second ejector 337, for instance, may cooperate.

In a variant the discharge station 42 comprises a discharge conveyor 140 positioned below the level of the roller conveyor 13, and therefore a surface carrying rollers to lower the wound bundle 23 becomes necessary.

We claim:

1. A line to process rolled stock of wire and rod having a diameter ranging from a few millimeters up to about 45 millimeters, comprising:

a roller conveyor;

a cooling tunnel located around at least a portion of the roller conveyor;

a head to form coils of wire and deposit the coils on the roller conveyor;

a reel to collect the coils of wire formed by the head and to form wound bundles of wire;

first and second Garrett-type reels located along lateral sides of said head, said Garrett-type reels being selectively rotatable and stationary;

at least one Edenborn-type coil-forming head which can cooperate with said Garrett-type reels to form wound bundles of wire or rod when said Garrett-type reels are stationary;

at least one intake which can cooperate with said Garrett-type reels to form wound bundles of wire or rod when said Garrett-type reels are rotated;

means for selectively supplying wire and rod to said head, said at least one Edenborn-type coil-forming head and said at least one intake; and a discharge conveyor to discharge wound bundles of wire and rod.

2. The line as claimed in claim 1, wherein said cooling tunnel is adjustable between three positions, at least one position being suitable for passage of wound bundles on the roller conveyor.

3. The line as claimed in claim 2, wherein said cooling tunnel has an entrance and an exit, and at least when in the position suitable for passage of wound bundles, comprises movable doors at the entrance and exit.

4. The line as claimed in claim 1, further comprising a means for discharging wound bundles from the roller conveyor onto the discharge conveyor, located at an end portion of the cooling tunnel.

5. The line as claimed in claim 1, further comprising a means for discharging wound bundles from the roller conveyor onto the discharge conveyor, located at an end portion of the discharge conveyor.

6. The line as claimed in claim 1, comprising a first Edenborn-type coil-forming head and a first intake which cooperate with the first Garrett-type reel, and a second Edenborn-type coil-forming head and a second intake which cooperate with the second Garrett-type reel.

7. The line as claimed in claim 6, further comprising:

a first carriage which supports the first Edenborn-type coil-forming head and first intake, and which is movable to cause either the first Edenborn-type coil-forming head or the first intake to cooperate with the first Garrett-type reel; and a second carriage which supports the second Edenborn-type coil-forming head and second intake, and which is movable to cause either the second Edenborn-type coil-forming head or the second intake to cooperate with the second Garrett-type reel.

* * * * *

UNITED STATES PATENT AND TRADEMARK OFFICE

CERTIFICATE OF CORRECTION

PATENT NO. : 4,807,457

DATED : February 28, 1989

INVENTOR(S) : Alfredo POLONI et al.

It is certified that error appears in the above-identified patent and that said Letters Patent is hereby corrected as shown below:

In the cover page: Item [19], replace "Polino et al." with --Poloni et al.--.

In the cover page: Item [75], replace "Alfredo Polino" with --Alfredo Poloni--.

Signed and Sealed this

Twenty-ninth Day of August, 1989

*Attest:*

*Attesting Officer*

DONALD J. QUIGG

*Commissioner of Patents and Trademarks*